US006824079B2

(12) United States Patent
Kendrick et al.

(10) Patent No.: US 6,824,079 B2
(45) Date of Patent: Nov. 30, 2004

(54) AEROSOL DISPENSER ASSEMBLY AND METHOD OF REDUCING THE PARTICLE SIZE OF A DISPENSED PRODUCT

(75) Inventors: Robert E. Kendrick, Oak Creek, WI (US); Leon C. Samuelson, Racine, WI (US); Kevin J. Moe, Racine, WI (US); Cary E. Manderfield, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/350,011

(22) Filed: Jan. 24, 2003

(65) Prior Publication Data

US 2004/0144863 A1 Jul. 29, 2004

(51) Int. Cl.[7] ..... B05B 7/30
(52) U.S. Cl. ..... 239/343; 239/354
(58) Field of Search ..... 239/340, 343, 239/354, 461, 518; 222/402.1

(56) References Cited

U.S. PATENT DOCUMENTS

| | | | | | |
|---|---|---|---|---|---|
| 3,018,023 | A | | 1/1962 | Talarico | 222/394 |
| 3,137,416 | A | | 6/1964 | Shepherd et al. | 222/394 |
| 3,544,258 | A | | 12/1970 | Presant et al. | 222/192 |
| 3,583,642 | A | * | 6/1971 | Crowell et al. | 239/337 |
| 3,630,415 | A | * | 12/1971 | Morane et al. | 222/129 |
| 3,635,261 | A | * | 1/1972 | Morane et al. | 141/3 |
| 3,647,119 | A | | 3/1972 | Samuelson | 222/402.18 |
| 3,648,932 | A | * | 3/1972 | Ewald et al. | 239/337 |
| 3,715,081 | A | * | 2/1973 | Green | 239/573 |

(List continued on next page.)

FOREIGN PATENT DOCUMENTS

| | | | |
|---|---|---|---|
| JP | 56-133065 | | 10/1981 |
| JP | 59-84801 | | 5/1984 |
| JP | 59-84802 | | 5/1984 |
| JP | 59-93001 | | 5/1984 |
| JP | 59-93002 | | 5/1984 |
| JP | 61-165320 | | 7/1986 |
| JP | 2-294382 | | 12/1990 |
| JP | 3-148212 | | 6/1991 |
| JP | 3-157328 | | 7/1991 |
| JP | 405042979 A | * | 2/1993 |
| JP | 9-67204 | | 3/1997 |

OTHER PUBLICATIONS

Joint Declaration of Richard S. Valpey III, Cary E. Manderfield, and Paul A. Clark, pp. 1–6, executed Apr. 27, 2004.

*Primary Examiner*—William Doerller
*Assistant Examiner*—Mohammad Ali

(57) ABSTRACT

An aerosol dispenser assembly (1) having a container (2) that contains a liquid product, and a propellant for propelling the liquid product from the container (2). The propellant is a dual phase hydrocarbon propellant, is free of normal butane, and is at most 25% by weight of the contents of the container. A valve (4) is attached to the container (2) for selectively dispensing the liquid product from the container (2) as a mist, the mist having an average particle size of less than 35 $\mu$m (0.0014"), over at least 75% of the life of the dispenser assembly (1). The dispenser assembly (1) is capable of dispensing over 98% by weight of the liquid product from the container (2). A vapor tap (24) is formed in the valve (4) to facilitate thorough mixing of the propellant and the liquid product prior to dispensing, and a valve stem (12) is disposed in the valve (4). The valve stem (12) defines at least one stem orifice (26) for flow of the product during dispensing. The vapor tap (24) has a diameter of about 0.013" (0.330 mm) to about 0.019" (0.483 mm). A dispenser cap (16) is mounted on the valve stem (12) for actuating the valve (4) to dispense the liquid product. The dispenser cap (16) defines an exit path (28), through which the liquid product can be dispensed. A breakup bar (30) is positioned in the exit path (28) of the dispenser cap (16) to break up the liquid product in order to reduce the size of the particles before the liquid product is dispensed.

21 Claims, 3 Drawing Sheets

U.S. PATENT DOCUMENTS

| | | | | | |
|---|---|---|---|---|---|
| 4,019,657 | A | | 4/1977 | Spitzer et al. | 222/136 |
| 4,056,500 | A | | 11/1977 | Stern | 260/29.6 |
| 4,116,370 | A | | 9/1978 | Spitzer et al. | 222/402.18 |
| 4,117,958 | A | | 10/1978 | Spitzer et al. | 222/402.18 |
| 4,124,149 | A | | 11/1978 | Spitzer et al. | 222/402.19 |
| 4,141,472 | A | | 2/1979 | Spitzer et al. | 222/189 |
| 4,152,416 | A | | 5/1979 | Spitzer et al. | 424/46 |
| 4,174,386 | A | | 11/1979 | Spitzer et al. | 424/47 |
| 4,203,552 | A | * | 5/1980 | Hayes | 239/337 |
| 4,230,243 | A | | 10/1980 | Spitzer et al. | 222/402.18 |
| 4,322,037 | A | | 3/1982 | Heeb et al. | 239/337 |
| 4,431,120 | A | | 2/1984 | Burger | 222/192 |
| 4,511,069 | A | * | 4/1985 | Kalat | 222/263 |
| 4,534,958 | A | | 8/1985 | Adams et al. | 424/45 |
| 4,680,173 | A | | 7/1987 | Burger | 424/47 |
| 4,935,224 | A | | 6/1990 | Russo et al. | 424/47 |
| 4,940,171 | A | | 7/1990 | Gilroy | 222/402.18 |
| 5,068,099 | A | | 11/1991 | Sramek | 424/47 |
| 5,082,652 | A | | 1/1992 | Mayfield et al. | 424/47 |
| 5,083,683 | A | * | 1/1992 | Knickerbocker | 222/382 |
| 5,125,546 | A | | 6/1992 | Dunne et al. | 222/394 |
| 5,211,317 | A | | 5/1993 | Diamond et al. | 222/394 |
| 5,304,368 | A | | 4/1994 | Shernov et al. | 424/47 |
| 5,314,097 | A | | 5/1994 | Smrt et al. | 222/402.1 |
| 5,340,871 | A | | 8/1994 | Pearson et al. | 523/526 |
| 5,348,992 | A | | 9/1994 | Pearson et al. | 523/523 |
| 5,467,902 | A | | 11/1995 | Yquel | 222/402.1 |
| 5,518,151 | A | | 5/1996 | Knickerbocker | 222/382 |
| 5,586,695 | A | | 12/1996 | Labus et al. | 222/396 |
| 5,603,919 | A | | 2/1997 | Liu et al. | 424/47 |
| 5,626,840 | A | | 5/1997 | Thomaides et al. | 424/70.11 |
| 5,639,441 | A | | 6/1997 | Sievers et al. | 424/9.3 |
| RE35,843 | E | | 7/1998 | Diamond et al. | 222/394 |
| 5,939,060 | A | * | 8/1999 | Trinh et al. | 424/76.4 |
| 5,957,341 | A | | 9/1999 | Schiestel | 222/394 |
| 5,975,356 | A | | 11/1999 | Yquel et al. | 222/54 |
| 5,988,455 | A | | 11/1999 | Pearson et al. | 222/402.1 |
| 6,112,633 | A | * | 9/2000 | Trocino | 86/50 |
| 6,173,907 | B1 | | 1/2001 | Benoist | 239/337 |
| 6,199,766 | B1 | | 3/2001 | Fox et al. | 239/3 |
| 6,260,738 | B1 | * | 7/2001 | Kerr et al. | 222/402.13 |
| 6,352,582 | B1 | * | 3/2002 | Brown | 106/3 |
| 6,357,633 | B1 | | 3/2002 | Zimmerhackel et al. | 222/402.1 |
| 6,358,893 | B1 | | 3/2002 | Zechman, III et al. | 508/215 |
| 6,375,049 | B1 | | 4/2002 | Geier | 222/402.1 |
| 6,394,321 | B1 | | 5/2002 | Bayer | 222/402.24 |
| 6,482,357 | B1 | * | 11/2002 | Fox et al. | 422/4 |

* cited by examiner

AEROSOL DISPENSER ASSEMBLY AND METHOD OF REDUCING THE PARTICLE SIZE OF A DISPENSED PRODUCT

FIELD OF THE INVENTION

The instant invention relates to an improved aerosol dispenser assembly that dispenses a liquid product as a fine spray having a reduced particle size, while reducing the amount of propellant required to dispense the liquid product from the container.

BACKGROUND OF THE INVENTION

Aerosol dispensers have been commonly used to dispense personal, household, industrial, and medical products, and to provide a low cost, easy to use method of dispensing a liquid product. Typically, aerosol dispensers include a container, which contains a liquid product to be dispensed, such as soap, insecticide, deodorant, disinfectant, or the like. A propellant is used to discharge the liquid product from the container. The propellant is under pressure and provides a force to expel the liquid product from the container when a user actuates the aerosol dispenser by, for example, pressing an actuator button.

The two main types of propellants used in aerosol dispensers today are liquefied gas propellants, such as hydrocarbon and hydrofluorocarbon (HFC) propellants, and compressed gas propellants, such as compressed carbon dioxide or nitrogen gas. To a lesser extent, chlorofluorocarbon propellants (CFCs) are also used. The use of CFCs is, however, being phased out due to the harmful effects of CFCs on the environment.

In an aerosol dispenser using the liquefied gas-type propellant (also known as a double phase propellant), the container is loaded with the liquid product and propellant, and pressurized to a pressure approximately equal to, or slightly greater than, the vapor pressure of the propellant. Since the container is pressurized to the vapor pressure of the propellant, a majority of the propellant is liquefied. However, a small portion of the propellant will remain in gaseous form. As the product is dispensed, the pressure within the container will decrease and more of the propellant will enter the gas phase. In a compressed gas aerosol dispenser, the propellant remains in gaseous form when the container is pressurized for use.

A conventional aerosol dispenser generally comprises a container (not shown) for holding a liquid product and a propellant, and a valve assembly for selectively dispensing a liquid product from the container. As illustrated in FIG. 3, the valve assembly 104 comprises a mounting cup 106, a mounting gasket 108, a valve body 10, a valve stem 112, a stem gasket 114, an actuator cap 116, and a return spring 118. The valve stem 112, stem gasket 114, and return spring 118 are disposed within the valve body 110 and are movable relative to the valve body 110 to selectively control dispensing of the liquid product. The valve body 110 is affixed to the underside of the mounting cup 106, such that the valve stem 112 extends through, and projects outwardly from, the mounting cup 106. The actuator cap 116 is fitted onto the outwardly projecting portion of the valve stem 112 and is provided with an actuator orifice 132. The actuator orifice 132 directs the spray of the liquid product into the desired spray pattern. A dip tube 120 is attached to the lower portion of the valve body 110 to supply the liquid product to the valve assembly 104 to be dispensed. As shown in FIG. 2, the whole valve assembly 104 is sealed to a container 102 by mounting gasket 108.

In operation, when the actuator cap 116 of the dispenser 101 is depressed, the propellant forces the liquid product up the dip tube 120 and into the valve body 110 via a body orifice 122. In the valve body 110, the liquid product is mixed with additional propellant supplied to the valve body 110 through a vapor tap 124. The vapor tap 124 helps to mix the liquid product and propellant in the valve body 110, to thereby break up the product into smaller particles suitable to be dispensed. From the valve body 110, the product is propelled through a stem orifice 126, out the valve stem 112, and through an actuator orifice 132 formed in the actuator cap 116.

S. C. Johnson & Son, Inc. (S. C. Johnson) employs an aerosol valve similar to that shown in FIG. 3 in connection with their line of Glade® aerosol air fresheners. The propellant used to propel the air freshener liquid product from the container is a B-Series propellant having a propellant pressure of 40 psig (B-40), at 70° F. (2.722 atm at 294.261 K). "Propellant pressure" refers to the approximate vapor pressure of the propellant, as opposed to "can pressure," which refers to the initial gauge pressure contained within a full aerosol container. The B-40 propellant is a composition of propane, normal butane, and isobutane. By normal butane it is meant the composition denoted by the chemical formula C4H10, having a linear backbone of carbon. In order to effectively dispense this air freshener composition, the aerosol dispenser used by S. C. Johnson in connection with their line of Glade® aerosol air fresheners has a stem orifice diameter of 0.025" (0.635 mm), a vapor tap diameter of 0.020" (0.508 mm), a body orifice diameter of 0.062" (1.575 mm), and a dip tube inner diameter of 0.060" (1.524 mm). This current Glade® aerosol air freshener requires that the B-40 propellant be present in the amount of approximately 29.5% by weight of the contents of the dispenser assembly.

Hydrocarbon propellants contain Volatile Organic Compounds (VOCs). The content of VOCs in aerosol air fresheners is regulated by various federal and state regulatory agencies, such as the Environmental Protection Agency (EPA) and California Air Resource Board (CARB). S. C. Johnson continuously strives to provide environmentally friendly products and regularly produces products that exceed government regulatory standards. It is in this context that S. C. Johnson set out to reduce the content of VOCs in their line of Glade® aerosol air fresheners.

One way in which to reduce the VOC content in such aerosol air fresheners is to reduce the content of the hydrocarbon propellant used to dispense the liquid product. However, we have discovered that a reduction in the propellant content adversely affects the product performance. Specifically, reducing the propellant content in the aerosol air freshener resulted in excessive product remaining in the container at the end of the life of the dispenser assembly (product retention) and an increase in the size of particles of the dispensed product (increased particle size). It is desirable to minimize the particle size of a dispensed product in order to maximize the dispersion of the particles in the air and to prevent the particles from "raining" or "falling out" of the air. Thus, we set out to develop an aerosol dispenser assembly that can satisfactorily dispense an aerosol product that contains, at most, 25% by weight, of a double phase hydrocarbon propellant, while actually improving product performance throughout the life of the dispenser assembly.

The "life of the dispenser assembly" is defined in terms of the pressure within the container (i.e., the can pressure), such that the life of the dispenser assembly is the period between when the pressure in the container is at its maximum and when the pressure within the container is substantially depleted, i.e., equal to atmospheric pressure.

One known method of reducing the particle size of a dispensed liquid product is disclosed in U.S. Pat. No. 3,583,642 to Crowell et al. (the '642 patent), which is incorporated herein by reference. The '642 patent discloses a spray head that incorporates a "breakup bar" for inducing turbulence in a product/propellant mixture prior to the mixture being discharged from the spray head. Such turbulence contributes to reducing the size of the mixture particles discharged from the spray head.

SUMMARY OF THE INVENTION

Our invention provides an improved aerosol dispenser assembly that dispenses substantially all of a liquid product (i.e., reduces product retention) as a fine spray having reduced particle size, while at the same time reducing the amount of propellant required to dispense the liquid product from the container.

In one aspect, an aerosol dispenser assembly according to our invention comprises a container that contains a liquid product and a propellant for propelling the liquid product from the container. The propellant is a dual phase hydrocarbon propellant, is free of normal butane, and constitutes at most 25% by weight of the contents of the container. The contents of the container are pressurized to between about 55 psig (3.743 atm) and about 120 psig (8.166 atm). In particular, the contents of the container are pressurized to between about 55 psig (3.743 atm) and about 80 psig (5.444 atm).

A valve is attached to the container for selectively dispensing the liquid product from the container as a mist, the mist having an average particle size of less than 35 $\mu$m (0.0014"), over at least 75% of the life of the dispenser assembly. Average particle size, as used herein, means average mean particle size D(V,0.5) of the dispensed product, as measured by a Malvern® Mastersizer 2600 Particle Size Analyzer. In addition, the dispenser assembly is capable of dispensing over 98% by weight of the liquid product from the container.

A vapor tap is formed in the valve to facilitate thorough mixing of the propellant and the liquid product prior to dispensing, and a valve stem is disposed in the valve. The valve stem defines at least one stem orifice for flow of the product during dispensing. The vapor tap has a diameter of about 0.013" (0.330 mm) to about 0.019" (0.483 mm).

A dispenser cap is mounted on the valve stem for actuating the valve to dispense the liquid product. The dispenser cap defines an exit path, through which the liquid product can be dispensed. A breakup bar is positioned in the exit path of the dispenser cap to break up the liquid product in order to reduce the size of the particles before the liquid product is dispensed.

A better understanding of these and other aspects, features, and advantages of the invention may be had by reference to the drawings and to the accompanying description, in which preferred embodiments of the invention are illustrated and described.

BRIEF DESCRIPTION OF THE DRAWINGS

Throughout the figures, like or corresponding reference numerals denote like or corresponding parts.

DESCRIPTION OF THE PREFERRED EMBODIMENTS

Figure 2:
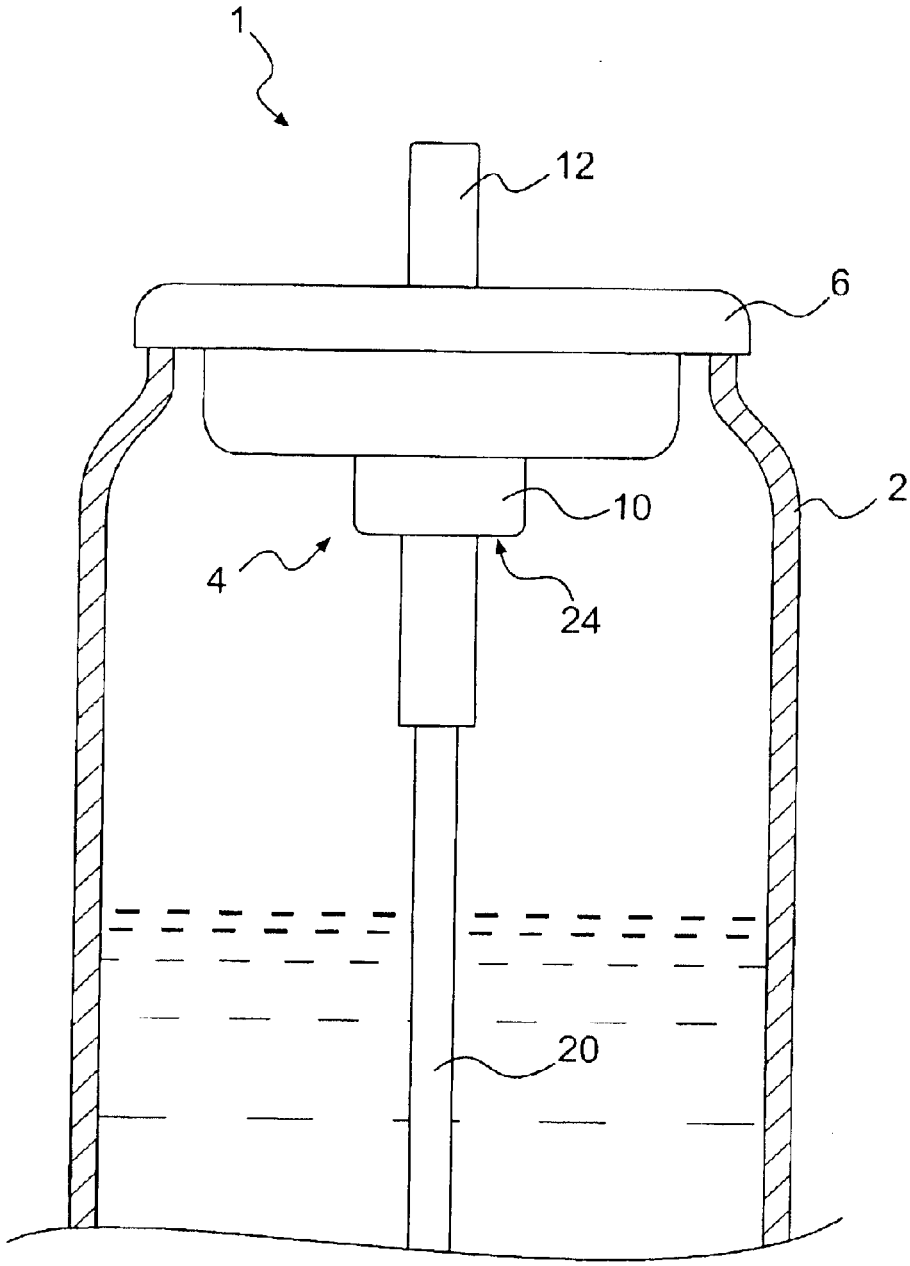
FIG. 2 is a front view of the aerosol dispenser assembly of the present invention.
Figure 3:
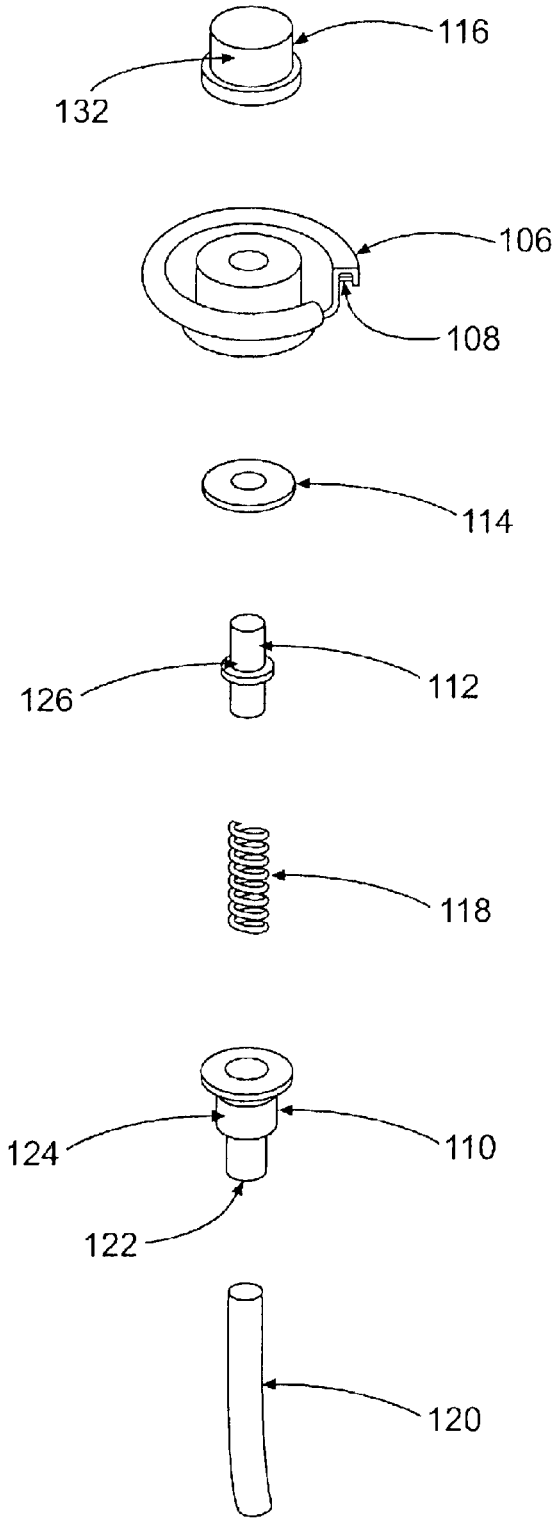
FIG. 3 PRIOR ART
FIG. 3 is an exploded view of a conventional aerosol valve assembly and actuator cap.

As shown in FIG. 2, an aerosol dispenser assembly according to our invention generally comprises a container 2 with a valve assembly 4 disposed in the top thereof for selectively dispensing a liquid product from the container 2.

Figure 1:
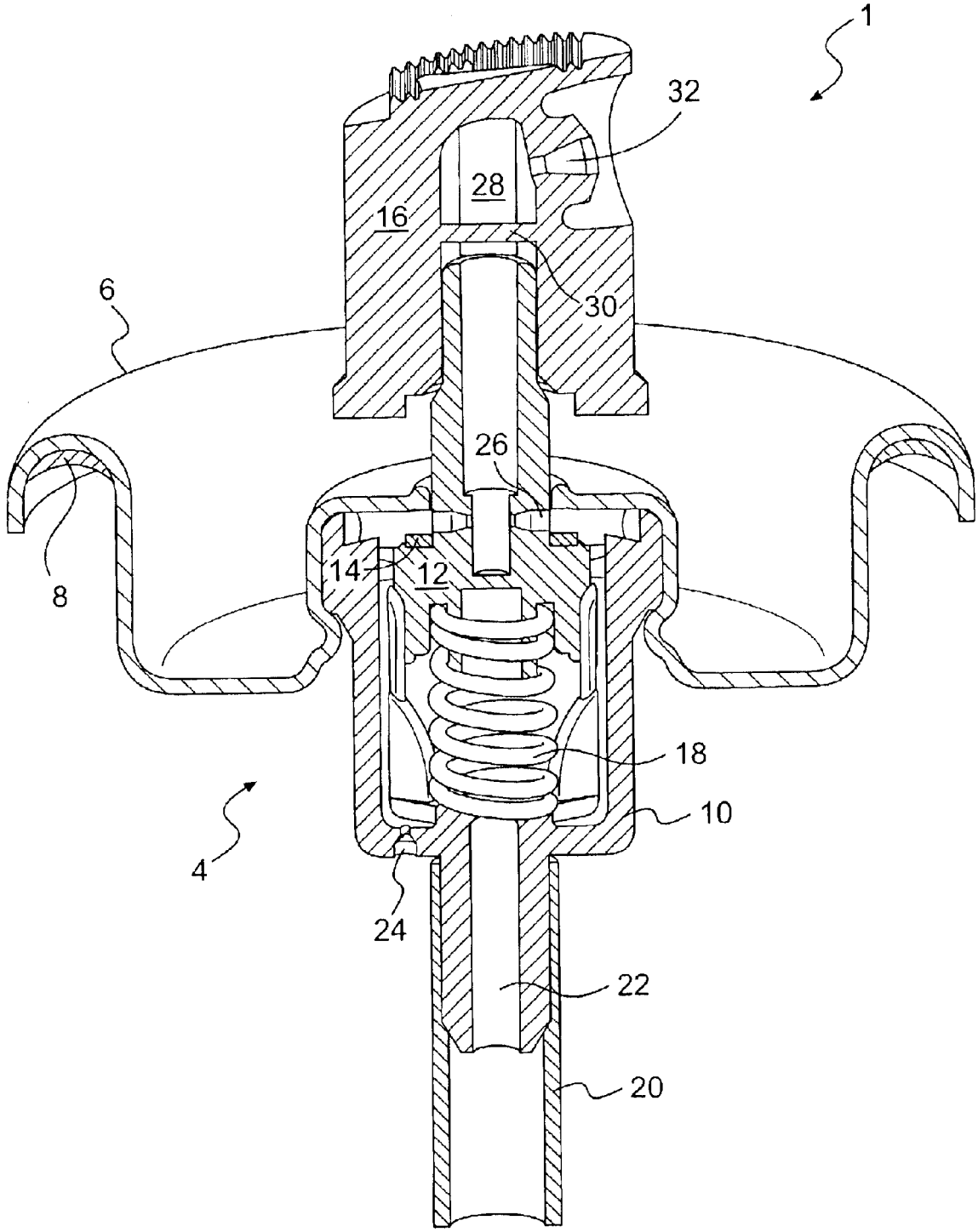
FIG. 1 is a cross-sectional perspective view of a first embodiment of the valve of the present invention.

With reference to FIG. 1, the valve assembly 4 further comprises a mounting cup 6, a mounting gasket 8, a valve body 10, a valve stem 12, a stem gasket 14, an actuator cap 16, and a return spring 18. The actuator cap 16 defines an exit path 28 and an actuator orifice 32. The valve stem 12, stem gasket 14, and return spring 18 are disposed within the valve body 10 and are movable relative to the valve body 10. The valve body 10 is affixed to the underside of the mounting cup 6, such that the valve stem 12 extends through, and projects outwardly from, the mounting cup 6. The actuator cap 16 is fitted onto the outwardly projecting portion of the valve stem 12, and a dip tube 20 is attached to the lower portion of the valve body 10. The whole valve assembly 4 is sealed to the container 2 by mounting gasket 8.

While the actuator cap 16 is shown in FIG. 1 as being a simple push-button actuator, it will be understood that any suitable actuator may be used, such as, for example, an actuator button with an integral overcap.

In operation, when the actuator cap 16 of the dispenser 1 is depressed, it forces the valve stem 12 to move downward, thereby allowing the liquid product to be dispensed. The propellant forces the liquid product up the dip tube 20 and into the valve body 10 via body orifice 22. In the valve body 10, the liquid product is mixed with additional propellant supplied to the valve body 10 through a vapor tap 24. The vapor tap 24 helps to mix the liquid product and propellant in the valve body 10, to thereby break up the product into smaller particles suitable to be dispensed. From the valve body 10, the liquid product is propelled through at least one stem orifice 26, out the valve stem 12, and through an exit path 28 formed in the actuator cap 16. As shown in FIG. 1, a pair of stem orifices 26 may be used. However, only one stem orifice is required. A breakup bar 30 is provided in the exit path, such that the product is forced to diverge around the breakup bar 30, thereby inducing turbulence in the flow of the product, further reducing the particle size of the product. The product is then expelled from the actuator cap 16 through an actuator orifice 32, which disperses the product and produces a desired spray pattern. In one variation of the dispenser assembly, instead of a breakup bar as shown in FIG. 1, the dispenser assembly might employ a pair of breakup plates positioned in or below the exit path 28.

As noted above, we found that reducing the hydrocarbon propellant content of an aerosol air freshener to at most 25% by weight adversely affected the product performance. Specifically, reducing the propellant content in the aerosol air freshener resulted in excessive product retention and an increased particle size. Consequently the air freshener exhibited excessive raining or falling out of the liquid product. In order to correct these adverse effects, we tested various different types of propellants, pressures, and valve orifice dimensions.

In particular, we tested two types of propellants, A-Series and B-Series propellants. Both types of propellants were found to be suitable for dispensing a liquid product from a container. We found, however, that the A-Series propellants tested unexpectedly produced a mist having significantly smaller particle size than did the B-series propellants, under the same conditions. This difference was especially pronounced toward the end of the life of the dispenser assembly, when the pressure remaining the container was lower. We believe that the superior mist producing ability of the A-Series propellants is due to the absence of normal butane in the A-Series propellants. As described above, the B-Series propellants contain a combination of propane, normal butane, and isobutane. In contrast, the A-series propellant does not contain any normal butane. As the product is dispensed from the actuator orifice 32, small droplets of the liquid product coated with a layer of fragrance oil and propellant are formed (that is, the dispensed product is an "oil out" emulsion). When these droplets are expelled from the dispenser assembly they "explode" adding to the dispersion of the liquid product. The absence of normal butane in the A-Series propellant facilitates a greater "droplet explosion," thereby reducing the particle size of the dispensed mist. This reduced particle size allows a greater amount of the dispensed product to remain suspended in the air for a longer period of time, thus, increasing the air freshening efficacy of the product.

While the invention is disclosed as being primarily used in connection with a hydrocarbon propellant, it should be understood that the invention could be adapted for use with other sorts of propellants. For example, HFC and CFC propellants might also be used in connection with a variation of the dispenser assembly of our invention.

In addition, we tested various different propellant pressures and found that, in general, higher-pressure propellants tended to dispense the product as a mist having smaller particle size than did lower-pressure propellants. In addition, the higher-pressure propellants somewhat reduced the amount of product retained in the container at the end of the life of the dispenser assembly. However, simply increasing the pressure in the prior art aerosol dispensers, without more, was found to be insufficient to expel a satisfactory amount of the liquid product from the container. Thus, we also examined the aerosol valve itself to determine how best to reduce the amount of product retention, while maintaining a satisfactorily small particle size of the dispensed product.

In order to minimize the amount of product retention of the dispenser assembly, we found that it was desirable to increase the amount of liquid product dispensed per unit of propellant. That is, by making the dispensed ratio of liquid product to propellant smaller (i.e., creating a leaner mixture), the same amount of propellant will be able to exhaust a greater amount of liquid product. Several valve components are known to affect the dispensed ratio of liquid product to propellant, the vapor tap, the stem orifice, the body orifice, and the inner diameter of the dip tube. In general, we found that decreasing the size of the vapor tap has the effect of creating a leaner mixture. However, reducing the size of the vapor tap also has the side effect of increasing the particle size of the dispensed product. Conversely, we found that decreasing the size of the stem orifice, body orifice, and/or dip tube inner diameter generally decreases the spray rate and the particle size, without substantially affecting the amount of product retention.

Based on the foregoing experimentation and analysis, we discovered that certain combinations of propellant type, can pressure, and valve orifice dimensions, produced a dispenser assembly that contains at most 25% by weight of a hydrocarbon propellant and has superior product performance over the prior art dispenser assemblies.

We also found that A-Series propellants, which are free from normal butane, have a greater droplet explosion and thereby reduce the particle size of the dispensed product.

Moreover, a dispenser assembly having a can pressure of between 55 psig (3.743 atm) and 120 psig (8.166 atm) was found to help reduce product retention while also reducing the particle size of the dispensed product. All pressures are taken at 70° F. (294.261 K), unless otherwise noted. As noted above, can pressure refers to the initial gauge pressure contained within the aerosol container. Still higher pressures could also be effectively used to dispense the liquid product from the container. As the pressure within the aerosol dispenser assembly is increased, however, the strength of the aerosol dispenser container (also referred to as an aerosol can) must also be increased. Federal regulations (DOT ratings) govern the strength of pressurized containers and specify that aerosol cans must meet a certain can rating for a given internal pressure. (For example, aerosol cans having an internal pressure of 140 psig or less at 130° F. (9.526 atm at 327.594 K) are known as "regular" or "unrated," since a higher DOT rating is not required. Aerosol cans having an internal pressure of 160 psig or less at 130° F. (10.887 atm at 344.261 K) have a DOT rating of 2P, and cans having an internal pressure of 180 psig or less at 130° F. (12.248 atm at 355.372 K) have a DOT rating of 2Q. The higher the specified can rating, the stronger the aerosol can must be.) Generally, a can having a higher rating will be more costly due to increased material and/or manufacturing costs. Thus, in order to minimize costs, it is preferable to use the lowest pressure possible while still maintaining satisfactory product performance. In this regard, we found that can pressures of between 55 psig (3.743 atm) and 80 psig (5.444 atm) were especially preferred because they require a lower can rating than would higher can pressures and are still capable of achieving the advantages of the present invention (i.e., reduced propellant content, reduced particle size, and minimal product retention).

We also found that the dispenser assembly of FIG. 1 was capable of satisfactorily dispensing an aerosol product that contains at most 25% by weight of a double phase hydrocarbon propellant, when the diameter of the vapor tap 24 is between about 0.013" (0.330 mm) and about 0.019" (0.483 mm), the diameter of the stem orifice 26 is between about 0.020" (0.508 mm) and about 0.030" (0.762 mm) when a single stem orifice is used (between about 0.014" (0.356 mm) and about 0.025" (0.635 mm) when a pair of stem orifices are used), the diameter of the body orifice is between about 0.050" (1.270 mm) and about 0.062" (1.575 mm), and the inner diameter of the dip tube is between about 0.040" (1.016 mm) and about 0.060" (1.524 mm).

Thus, any of the above described valve components, propellant types, propellant pressures, and valve orifice dimensions, may be used in combination to provide a dispenser assembly according to our invention.

In one currently preferred embodiment of the invention, the aerosol dispenser assembly 1 uses an A-Series propellant having a propellant pressure of about 60 psig (4.083 atm) (i.e., A-60 propellant) to dispense the liquid product from the container 2. In this embodiment, the container is initially pressurized to a can pressure of about 70 psig (4.763 atm) to about 80 psig (5.444 atm). The diameter of the vapor tap 24 in this embodiment is about 0.016" (0.406 mm). Two stem orifices 26 are used, each having a diameter of about 0.024" (0.610 mm). The diameter of the body orifice is about 0.050" (1.270 mm), and the inner diameter of the dip tube is about 0.060" (1.524 mm). Furthermore, a breakup bar 30 is positioned in the exit path 28 of the actuator 16 in order to further reduce the particle size of the dispensed product.

Another currently preferred embodiment of the dispenser assembly 1 employs a single stem orifice 26. In this embodiment, the dispenser assembly 1 also uses the A-60 propellant and a can pressure of about 70 psig (4.763 atm) to about 80 psig (5.444 atm) to dispense the liquid product from the container 2. The diameter of the vapor tap is about 0.016" (0.406 mm), the diameter of the single stem orifice is about 0.025" (0.635 mm), the diameter of the body orifice is about 0.062" (1.575 mm), and the inner diameter of the dip tube is about 0.060" (1.524 mm). This embodiment also employs a breakup bar, positioned in the exit path of the actuator to further reduce the particle size of the dispensed product.

These currently preferred embodiments of the dispenser assembly are capable of dispensing the liquid product contained within the container as a mist having an average particle size of less than 35 $\mu$m (0.0014"), over at least 75% of the life of the dispenser assembly. Because the dispensed mist has such a small particle size, the particles are more easily dispersed in the air and less fallout is experienced. This reduction in the amount of fallout increases the dispenser assembly's air freshening efficacy and helps to prevent undesirable residue of the liquid product from settling on flat surfaces, such as, countertops, tables, or floors.

Moreover, both preferred embodiments of the dispenser assembly are capable of dispensing over 98% by weight of the liquid product from the container. It is important that substantially all of the product can be dispensed, to insure that product label claims will be met. Also, by minimizing the amount of product retained in the container at the end of the life of the dispenser assembly, less liquid product is wasted. This is important from a consumer satisfaction standpoint, since consumers tend to be more satisfied with a dispenser assembly when substantially all of the liquid product can be dispensed.

The embodiments discussed above are representative of preferred embodiments of the present invention and are provided for illustrative purposes only. They are not intended to limit the scope of the invention. Although specific components, configurations, materials, etc., have been shown and described, such are not limiting. For example, various other combinations of valve components, propellant types, propellant pressures, and valve orifice dimensions, can be used without departing from the spirit and scope of our invention, as defined in the claims.

What is claimed is:

1. An aerosol dispenser assembly comprising:

a container that contains a liquid product and a propellant for propelling the liquid product from said container, wherein the propellant is a dual phase propellant and is at most 25% by weight of the contents of said container; and a valve attached to said container for selectively dispensing the liquid product from said container as a mist, wherein the dispensed mist has an average particle size of less than 35 $\mu$m, over at least 75% of the life of said dispenser assembly.

2. An aerosol dispenser assembly according to claim 1, wherein the propellant is a hydrocarbon propellant.

3. An aerosol dispenser assembly according to claim 2, wherein the propellant is free of normal butane.

4. An aerosol dispenser assembly according to claim 1, wherein the contents of said container are pressurized to between about 55 psig and about 120 psig.

5. An aerosol dispenser assembly according to claim 1, wherein the contents of said container are pressurized to between about 55 psig and about 80 psig.

6. An aerosol dispenser assembly according to claim 1, wherein the contents of said container are pressurized to between about 70 psig and about 80 psig.

7. An aerosol dispenser assembly according to claim 1, further comprising a vapor tap formed in said valve to facilitate thorough mixing of the propellant and the liquid product prior to dispensing, and a valve stem disposed in said valve and defining at least one stem orifice for flow of the product during dispensing.

8. An aerosol dispenser assembly according to claim 7, wherein said vapor tap has a diameter of about 0.013" to about 0.019".

9. An aerosol dispenser assembly according to claim 7, wherein said valve stem defines a pair of stem orifices.

10. An aerosol dispenser assembly according to claim 7, further comprising:

a dispenser cap mounted on said valve stem for actuating said valve to dispense the liquid product, said dispenser cap defining an exit path for the liquid product to be dispensed; and a breakup bar positioned in the exit path of said dispenser cap to break up the liquid product in order to reduce the size of the particles before the liquid product is dispensed.

11. An aerosol dispenser assembly comprising:

a container for containing a liquid product and a propellant for propelling the liquid product from said container, wherein the propellant is a dual phase propellant and is at most 25% by weight of the contents of said container; and a valve attached to said container for selectively dispensing the liquid product from said container as a mist, wherein the dispensed mist has an average particle size of less than 35 $\mu$m, over at least 75% of the life of said dispenser assembly, and wherein said dispenser assembly is capable of dispensing over 98% by weight of the liquid product from said container.

12. An aerosol dispenser assembly according to claim 11, wherein the propellant is a hydrocarbon propellant.

13. An aerosol dispenser assembly according to claim 11, wherein the propellant is free from normal butane.

14. An aerosol dispenser assembly according to claim 11, wherein the contents of said container are pressurized to between about 55 psig and about 120 psig.

15. An aerosol dispenser assembly according to claim 11, wherein the contents of said container are pressurized to between about 55 psig and about 80 psig.

16. An aerosol dispenser assembly according to claim 11, wherein the contents of said container are pressurized to between about 70 psig and about 80 psig.

17. An aerosol dispenser assembly according to claim 11, further comprising a vapor tap formed in said valve to facilitate thorough mixing of the propellant and the liquid product prior to dispensing, and a valve stem disposed in said valve and defining at least one stem orifice for flow of the product during dispensing.

18. An aerosol dispenser assembly according to claim 15, wherein said vapor tap has a diameter of about 0.013" to about 0.019".

19. An aerosol dispenser assembly according to claim 16, wherein said valve stem defines a pair of stem orifices.

20. An aerosol dispenser assembly according to claim 15, further comprising:

a dispenser cap mounted on said valve stem for actuating said valve to dispense the liquid product, said dispenser cap defining an exit path for the liquid product to be dispensed; and a breakup bar positioned in the exit path of said dispenser cap to break up the liquid product in order to reduce the size of the particles before the liquid product is dispensed.

21. An aerosol dispenser assembly comprising:

a container that contains a liquid product and a propellant for propelling the liquid product from said container, wherein the propellant is a dual phase hydrocarbon propellant, is free of normal butane, and is at most 25% by weight of the contents of said container, and wherein the contents of said container are pressurized to between about 55 psig and about 80 psig;

a valve attached to said container for selectively dispensing the liquid product from said container as a mist, wherein the dispensed mist has an average particle size of less than 35 $\mu$m, over at least 75% of the life of said dispenser assembly, and wherein said dispenser assembly is capable of dispensing over 98% by weight of the liquid product from said container;

a vapor tap formed in said valve to facilitate thorough mixing of the propellant and the liquid product prior to dispensing, said vapor tap having a diameter of about 0.013" to about 0.019";

a valve stem disposed in said valve and defining at least one stem orifice for flow of the product during dispensing;

a dispenser cap mounted on said valve stem for actuating said valve to dispense the liquid product, said dispenser cap defining an exit path for the liquid product to be dispensed; and a breakup bar positioned in the exit path of said dispenser cap to break up the liquid product in order to reduce the size of the particles before the liquid product is dispensed.

* * * * *